United States Patent [19]

Junker

[11] 4,289,110

[45] Sep. 15, 1981

[54] SHAPING ROLL

[76] Inventor: Erwin Junker, Talstrasse 78, 7611 Nordrach-Baden, Fed. Rep. of Germany

[21] Appl. No.: 85,056

[22] Filed: Oct. 12, 1979

[51] Int. Cl.[3] ..... B24B 53/06; B23G 5/00

[52] U.S. Cl. ..... 125/11 CD; 51/288; 125/39

[58] Field of Search ..... 125/11 R, 11 CD, 39; 51/95-288

[56] References Cited

U.S. PATENT DOCUMENTS

| | | | |
|---|---|---|---|
| 2,668,401 | 2/1954 | Reimschissel | 51/288 |
| 3,561,171 | 2/1971 | Van Vleet | 51/228 |

FOREIGN PATENT DOCUMENTS

| | | | |
|---|---|---|---|
| 2147100 | 6/1972 | Fed. Rep. of Germany | 51/288 |
| 655720 | 8/1951 | United Kingdom | 125/39 |
| 553091 | 5/1977 | U.S.S.R. | 51/288 |
| 642137 | 1/1979 | U.S.S.R. | 51/288 |

*Primary Examiner*—Harold D. Whitehead

*Attorney, Agent, or Firm*—Wenderoth, Lind & Ponack

[57] ABSTRACT

A shaping roll for forming a grinding wheel of a longitudinal-feed thread grinding machine used for the manufacture of threads including a conically tapered first thread portion and a cylindrical second thread portion includes a first groove having flank and radius configurations corresponding to the conically tapered first thread portion to be formed, a first cylindrical end surface adjacent the first groove and having a first diameter, a second groove having flank and radius configurations corresponding to the cylindrical thread portion to be formed, and a second cylindrical end surface adjacent the second groove and having a second diameter. The depth of the first groove is less than the depth of the second groove. The bottoms of the first and second grooves are spaced by an axial distance equal to an integral multiple of the pitch of the thread to be formed less an amount equal to the pitch distortion of the thread to be formed at the area of transition between the last thread of the concally tapered first thread portion and the cylindrical second thread portion. The first diameter of the first cylindrical end surface is greater than the second diameter of the second cylindrical end surface. An intermediate cylindrical surface is positioned axially between the first and second grooves and has a diameter less than the first diameter and greater than the second diameter.

4 Claims, 6 Drawing Figures

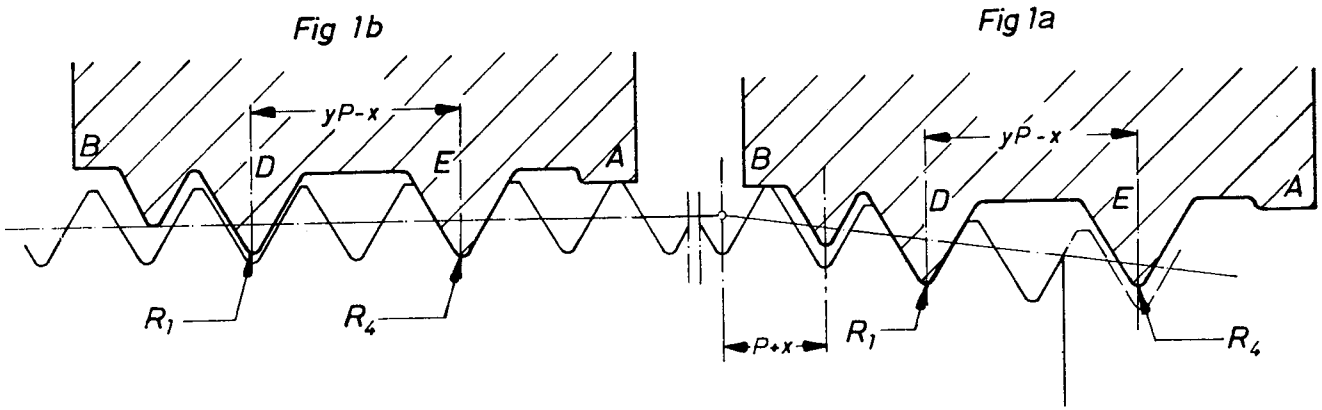
Fig 1a
Fig 1b
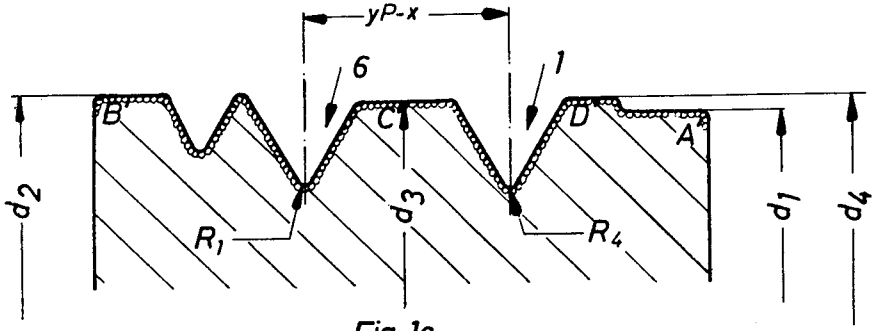
Fig. 1c

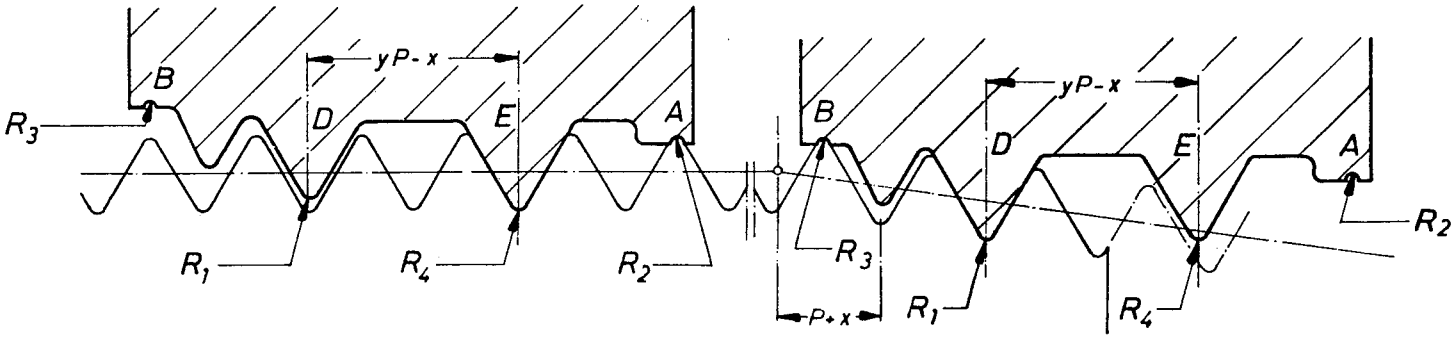
Fig. 2a
Fig. 2b
A
B
C
D
E
yP-x
P+x
R1
R2
R3
R4
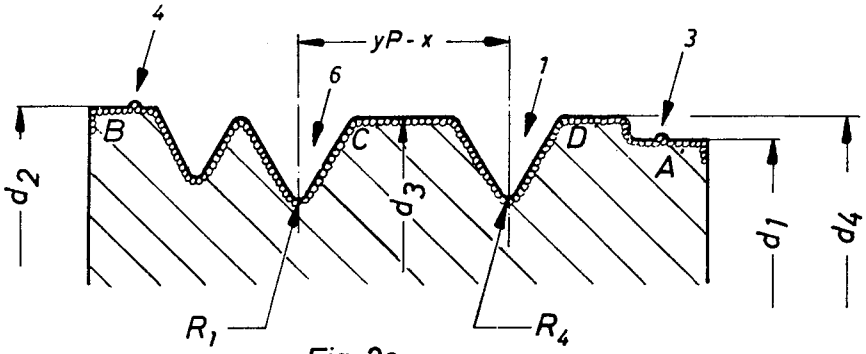
Fig. 2c
A
B
C
D
yP-x
1
3
4
6
R1
R4

SHAPING ROLL

BACKGROUND OF THE INVENTION

The invention concerns a shaping roll for forming a grinding wheel of a longitudinal-feed thread grinding machine for the manufacture of non-cutting thread formers with conical taper. The sloping roll has at least two grooves which correspond to the thread to be produced, in their included angle and core radius, and also has cylindrical surfaces in its end regions and between the grooves.

West German AS No. 2,519,429 discloses a shaping roll for a grinding wheel of a longitudinal-feed thread grinding machine which optimally works the shape into the grinding wheel for manufacturing tap drills. With this known roll modified pre-roll ribs are provided, the core radii of which progressively increase toward the ends of the roll, while the included angles progressively decrease.

SUMMARY OF THE INVENTION

The problem underlying the invention is to design the shape of a roll of the type characterized above such that, using a grinding wheel shaped with this roll, the flanks, the outer diameter, and the crown line of the initial cut and also the segment of a non-cutting thread former with a conical taper, which segment corresponds to the final shape of the desired thread, can all be ground in one operation.

This problem is solved according to the invention by providing: that the distance between the two grooves of the shaping roll is an integral multiple of the pitch of the thread to be produced, reduced by an amount equal to the pitch distortion of the thread core in the last thread of the conical thread region up to the transition to the cylindrical thread region, that the cylindrical surfaces of the endward regions of the shaping roll have different diameters, and that the diameter of the cylindrical surfaces between the grooves is intermediate between the diameters of the cylindrical surfaces located at the end regions of the roll.

Each end cylindrical surface may have extending therefrom an annular projection with a circular cross section.

Advantageously the distance of each projection from the center of the neighboring groove is 0.5 or 1.5 times the pitch of the thread to be produced.

It is of practical value to have an additional cylindrical surface between the one end cylindrical surface with the smaller diameter and the neighboring groove, with such additional cylindrical surface having a larger diameter than the one end cylindrical surface.

The basic advantage of this design of a shaping roll according to the invention is that it is not expensive from a technical point of view, yet with it the outer diameter of the thread in the conical region is ground over by one even surface of the grinding wheel which is shaped by the shaping roll, and the adjoining thread turns in the cylindrical region of the thread-former, which thread-former contains the desired threads which are to be produced, are ground over by another surface of the grinding wheel which is shaped by the shaping roll. These grinding surfaces are oriented with respect to each other in such a way that if one even surface of the grinding wheel is grinding the outer diameter of the thread of the conical or cylindrical segment, the other even surface will not be in grinding position and may undergo maintenance such as refinishing.

Further, in the last thread of the conical thread region of a non-cutting thread former there is as a matter of course a distortion of the pitch in the thread core up to the transition point to the cylindrical thread region. When the thread in the thread former is fabricated with a grinding wheel which has been shaped with a roll according to the invention, this distortion is simultaneously corrected.

BRIEF DESCRIPTION OF THE DRAWINGS

Additional advantages will be seen from the following illustrative description of exemplary embodiments of the invention, with reference to the attached drawings, wherein:

FIGS. 1*a* and 1*b* are partial cross sections showing a grinding wheel during grinding of the outer diameter and the flanks of the conical and cylindrical thread segments of a workpiece, respectively;

FIG. 1*c* is a partial cross section of a shaping roll for forming the grinding wheel of FIGS. 1*a* and 1*b;*

FIGS. 2*a* and 2*b* are partial cross sections similar to FIGS. 1*a* and 1*b*, but for a grinding wheel of a different shape; and FIG. 2*c* is a partial cross section of the shaping roll used to shape the grinding wheel shown in FIGS. 2*a* and 2*b*.

DETAILED DESCRIPTION OF THE INVENTION

The shaping roll shown in cross section in FIG. 1*c* has two grooves 1 and 6. There are end cylindrical surfaces A′ and B′ with different diameters $d_1$ and $d_2$, and between grooves 1 and 6 there is an additional cylindrical surface C′ with a diameter $d_3$ of a magnitude intermediate between $d_1$ and $d_2$. Grooves 1 and 6 have different depths (elevations), and their separation distance is less than an integral multiple of the thread pitch of the non-cutting thread former by a distance x which represents the distortion in the pitch which occurs in the core of the last thread of the conical thread region up to the transition to the cylindrical region. Between the end cylindrical surface A′ with the smaller diameter $d_1$ and the neighboring groove 1 there is a cylindrical surface D′ with a diameter $d_4$ larger than diameter $d_1$. Additionally, this shaping roll has a pre-roll groove to shape a taper tap on the grinding wheel, and the shape of this is transferred to the grinding wheel shown in FIGS. 1*a* and 1*b*. The grinding wheel has two grinding ridges D and E (corresponding to grooves 6 and 1 on the roll) which are also separated by a distance which corresponds to the pitch of the thread which is to be produced in the workpiece, and this distance is also reduced by the amount x which is the amount of the correction to be made. Also, corresponding to the shape of the roll shown in FIG. 1*c*, grinding ridge E has a greater depth or radial extent than grinding ridge D, and this depth difference may be chosen freely, within certain limits. In the embodiment shown, when the outer diameter in the conical region is being ground, the grinding ridge E and surface region A lie free and exposed (FIG. 1*a*), and when the outer diameter in the cylindrical region is being ground the grinding ridge D and the other surface segment B lie free and exposed (FIG. 1*b*).

In this way the ridges with radii $R_1$ and $R_4$ grind the core diameters of corresponding radii.

During the grinding by side B of the grinding wheel of the outer diameter or the crown line of the thread in the conical region, the opposite side A lies free and exposed. When the transition point, i.e., the crossing point, between the cylindrical and conical thread regions is passed, side A of the grinding wheel then grinds the outer diameter of the cylindrical region. Meanwhile side B of the grinding wheel becomes free and exposed, as a consequence of the design.

In FIG. 2*c* a cross section of a roll is shown which has a shape which corresponds basically to the shape shown in FIG. 1*c* with the exception that surface segments A' and B' have extending therefrom prominences 3 and 4 having circular cross sections. Here the distance from each prominence 3 or 4 to the middle of the neighboring groove 1 or 6, respectively is 0.5 or 1.5 times the pitch of the thread which is to be produced. Using a grinding wheel shaped with the roll shown in FIG. 2*c*, thread-formers are produced which have radii of the outwardly-narrowing flanks which resemble or match a Whitworth thread. These radii $R_2$ and $R_3$ are the same in the example shown.

The presence of the taper taps is not imperative. Their size and number may be freely chosen, within certain bounds of technical achievability. These taper taps will be added to the roll shown in FIG. 2, and will change its profile accordingly by their addition.

Also freely choosable is the distance yP−x indicated in FIG. 2*a*, where yP is an integral multiple of the pitch. The distance x is the distortion in the pitch, as discussed above.

In the process by which the thread-formers are fabricated it is immaterial whether the workpiece or the grinding wheel is moved radially with respect to the other. What is important is that the radial motion has a definite relation to the axial motion.

Although thread formers with a starting region of three threads can be fabricated using the shaping rolls of the illustrated embodiments, obviously with different roll profiles thread-formers of any dimension are possible. Using the rolls illustrated in the described embodiments all types of threads can be produced embodying British Whitworth threads, with the appropriate execution of the roll design.

The starting threads and the cylindrically running threads may have different and various crown shapes, e.g.:

(a) The cylindrical and conical regions may have parallel ground crown sections.

(b) The cylindrical and conical regions may have radii in the thread crowns.

(c) The conical part may have radii ground crown sections, and the cylindrical part may have even, cylindrical ground crown sections.

(d) The cylindrical part may have radii ground crown sections, and the conical part may have even, cylindrical ground crown sections.

(e) The cylindrical part may have radii ground crown sections, and the conical part may have flat ground crown sections which follow the starting angle.

(f) The cylindrical part may have flat ground crown sections, and the conical part may have flat ground crown sections which follow the starting angle.

For each desired thread configuration a shaping roll is used which has a corresponding shape.

Each shaping roll has a circular cross section and rotates around its own axis, as it is driven by a motor. The active part of the shaping roll in the embodiments shown is provided with a diamond surfacing, which increases service life. This surfacing is signified by the small circles in FIGS. 1*c* and 2*c*.

I claim:

1. A shaping roll for forming a grinding wheel of a longitudinal feed thread grinding machine used for the manufacture of threads including a conically tapered first thread portion and a cylindrical second thread portion, said shaping roll having:

a first groove having flank and radius configurations corresponding to the conically tapered first thread portion to be formed;

a first cylindrical end surface adjacent said first groove and having a first diameter;

a second groove having flank and radius configurations corresponding to the cylindrical second thread portion to be formed;

a second cylindrical end surface adjacent said second groove and having a second diameter;

the depth of said first groove being less than the depth of said second groove;

the bottoms of said first and second grooves being spaced by an axial distance equal to an integral multiple of the pitch of the thread to be formed less an amount equal to the pitch distortion of the thread to be formed at the area of transition between the last thread of the conically tapered first thread portion and the cylindrical second thread portion;

said first diameter of said first cylindrical end surface being greater than said second diameter of said second cylindrical end surface; and an intermediate cylindrical surface positioned axially between said first and second grooves and haing a diameter less than said first diameter and greater than said second diameter.

2. A shaping roll as claimed in claim 1, wherein said first cylindrical end surface has extending outwardly therefrom a first annular protrusion having a circular cross-section, and said second cylindrical end surface has extending outwardly therefrom a second annular protrusion having a circular cross-section.

3. A shaping roll as claimed in claim 2, wherein said first and second protrusions are axially spaced from said first and second grooves, respectively, by 0.5 or 1.5 times the pitch of the thread to be produced.

4. A shaping roll as claimed in claim 1, further comprising an additional cylindrical surface positioned between said second cylindrical end surface and said second groove, said additional cylindrical surface having a diameter greater than said second diameter.

* * * * *